United States Patent [19]

Bouix

[11] Patent Number: 5,038,964

[45] Date of Patent: Aug. 13, 1991

[54] PRESSURIZED CONTAINER INCLUDING A VALVE AND A DEVICE FOR ACTUATING THE VALVE

[75] Inventor: Hervé F. Bouix, Marley le Roi, France

[73] Assignee: L'Oreal, Paris, France

[21] Appl. No.: 458,747

[22] PCT Filed: May 5, 1989

[86] PCT No.: PCT/FR89/00220

§ 371 Date: Dec. 15, 1989

§ 102(e) Date: Dec. 15, 1989

[87] PCT Pub. No.: WO89/10881

PCT Pub. Date: Nov. 16, 1989

[30] Foreign Application Priority Data

May 10, 1988 [FR] France ..... 88 06271

[51] Int. Cl.[5] ..... B65D 83/14; B65D 55/02; B65D 47/24

[52] U.S. Cl. ..... 222/153; 222/145; 222/402.11; 206/219

[58] Field of Search ..... 222/153, 402.11, 402.13, 222/94, 145; 206/219, 222; 137/38

[56] References Cited

U.S. PATENT DOCUMENTS

| | | | |
|---|---|---|---|
| 2,954,904 | 10/1960 | Potoczky | 222/402.11 |
| 3,186,605 | 6/1965 | Potoczky | 222/402.11 |
| 3,788,523 | 1/1974 | Thomas | 222/402.11 |
| 4,121,772 | 10/1978 | Cronan | 206/219 |
| 4,518,103 | 5/1985 | Lim et al. | 222/135 |
| 4,524,078 | 6/1985 | Bardsley et al. | 206/222 |

*Primary Examiner*—Andres Kashnikow
*Assistant Examiner*—Karen B. Merritt
*Attorney, Agent, or Firm*—Cushman, Darby & Cushman

[57] ABSTRACT

A pressurized container (1) including a system (6) for blocking the pushbutton (54), located between the device (5) for actuating the valve ad the cup (31) in which the valve (4) is disposed. This system comprises a suitably inclined conduit (64) in which a movable device (63) circulates by gravity and blocks the pushbutton when it is located at the end (64*a*) of the conduit located toward the valve. This blocking system makes it possible to prevent the use of the pressurized container when it is in an undesirable top up or top down position.

21 Claims, 2 Drawing Sheets

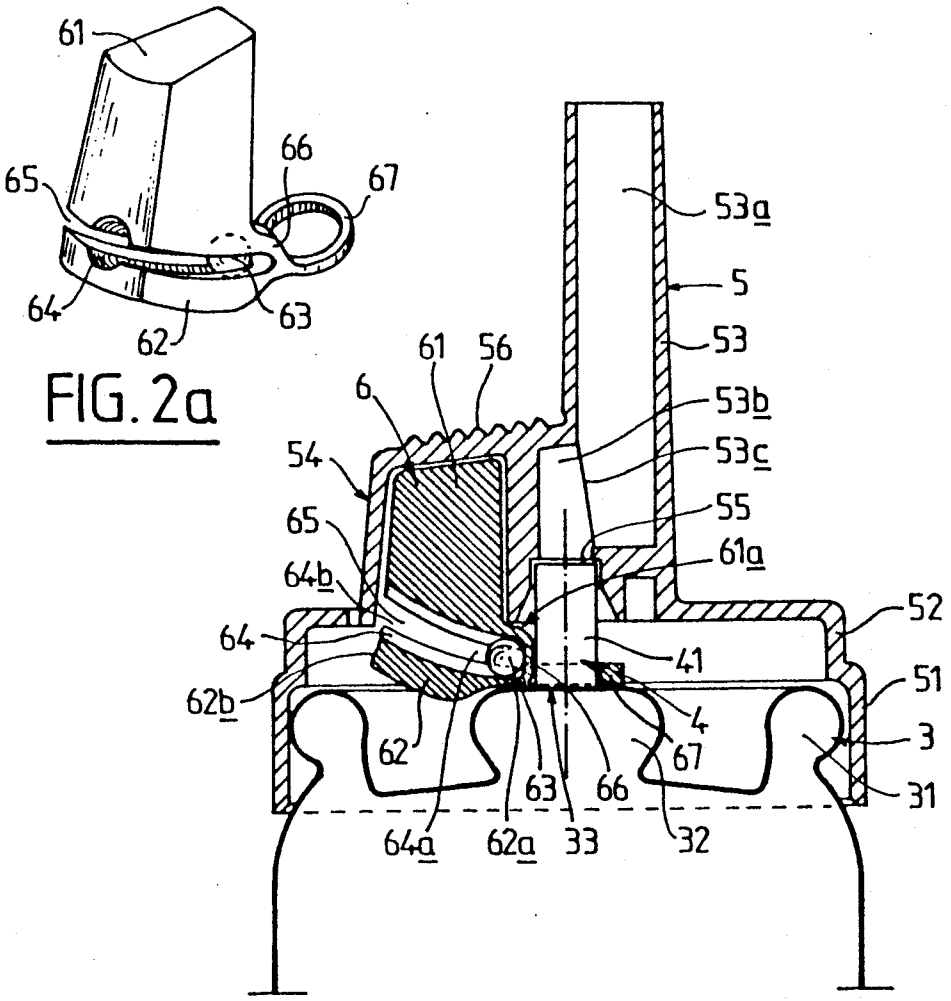
FIG. 2
FIG. 2a
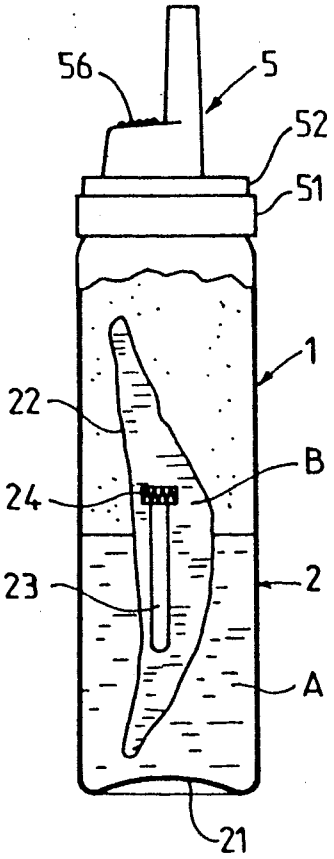
FIG. 1

PRESSURIZED CONTAINER INCLUDING A VALVE AND A DEVICE FOR ACTUATING THE VALVE

BACKGROUND OF THE INVENTION

It is well known that pressurized containers of the aerosol bomb type comprise a can, most often cylindrical, that contains both the product to be dispensed and a pressurized propellant, as well as a valve to enable dispensing the product under the influence of the propellant and a device for actuation of the valve by the user.

The valve is generally disposed in the center of a cup that is crimped to the edge of the cylindrical can with a bead. It is actuated by a device that fits onto the pressurized container at the end having the valve. This device includes a skirt solidly joined to the cylindrical can in telescoping fashion or by being screwed to it; a regulating nozzle connected to the outlet tube of the valve, the outlet tube generally being fixed to the cup with the aid of a reinforcement; and a device for actuating the valve, hereinafter simply called a pushbutton, on which the user presses, and with which the valve can be made to operate and the product to be dispensed can be brought to the regulating nozzle.

Depending on how the product is to be dispensed, the pressurized container is made to function by keeping the valve at the top (a position hereinafter called top up) or at the bottom (a position hereinafter called top down). In the first case the valve is generally connected to a plunger tube located inside the container in such a way as to use the product contained until it is exhausted. If the container is used in an unsuitable position, the risk is that some of the propellant may escape by itself, without the product to be dispensed, or carrying only a small quantity of product to be dispensed with it.

In certain cases, which will be described in further detail below, it is necessary obligatorily to use the pressurized container initially in a first predetermined position, for example in order to allow a gas at overpressure or a protective gas different from the propellant to escape, with later use for distribution of the product being performed in the other position.

The user consequently runs the risk of using the container in the wrong position, resulting in a loss of the product or the propellant.

The attempt has thus been made to develop a system that locks the pushbutton and prevents the opening of the valve when the pressurized container is not in the proper position.

SUMMARY OF THE INVENTION

The present invention relates to a pressurized container including a system that blocks the pushbutton when the pressurized container is not in the proper position.

The present invention relates to a pressurized container including a valve and device for actuating the valve, the container being provided at one end with a cup crimped to its edge and in which the valve is disposed, the device for actuating the valve including a pushbutton and forming a cap on top of the cup and valve, characterized in that between the cup and the valve actuating device, a system for blocking the pushbutton when the pressurized container is not in the desired top up or top down position is provided; that this blocking system includes a movable device circulating by gravity in a conduit extending from the vicinity of the valve toward the outside, said conduit being inclined such that when the container is not in the desired position, the movable device can be displaced by gravity toward the end of the conduit located in the vicinity of the valve; that the conduit is defined between an element for transmission of the thrust on the pushbutton and a tongue, the transmission element being capable of being displaced with respect to the container and the tongue; and that the action of the movable element combined with that of the transmission element and the tongue blocks the pushbutton when the movable element is in the vicinity of the valve.

The movable device may be a roller but is preferably a ball.

The pressurized container is preferably cylindrical, the valve being disposed in the center of the circular cup, and the conduit being disposed in the vicinity of the valve radially toward the outside.

The conduit defined between the element for transmitting the thrust on the pushbutton and the tongue has a cross section of dimensions such that the movable device can circulate freely. That is, this cross section has dimensions at least slightly greater than the corresponding cross section of the movable device.

To prevent the movable device from having a tendency to leave the conduit when it circulates in it, or for example if the pressurized container is shaken, the transmission element and/or the tongue are preferably hollow, in the form of a gutter.

In a preferred embodiment of the conduit, the conduit has a smaller cross section in the vicinity of the valve than at its end located toward the outside. This facilitates the passage of the ball from the blocking position to the functional position of the pushbutton.

In a first exemplary embodiment, the end of the tongue remote from the valve toward the outside is mounted in a floating manner; the end of the tongue located in the vicinity of the valve rests on a fixed surface; and the tongue is made of an elastic material.

In a second embodiment, the tongue is of rigid material; its end remote from the valve rests on the top and/or the rim of the cup; and the space between the transmission element and the tongue at the end is larger than the diameter of the movable device.

The transmission element and the tongue may be independent; in that case, the transmission element is affixed to the pushbutton. This fixation may be done by internesting, but is preferably done by gluing.

The transmission element and the tongue may be connected to one another via a flexible device, in particular a film hinge, the latter having a slight thickness, to make it flexible. The tongue is fixed to the valve by a yoke or by lugs. In a preferred embodiment, the transmission element, the tongue, the yoke or lugs and the film hinge form a single piece obtained by molding of plastic, preferably elastic material.

In a particular embodiment, the tongue, at the end remote from the valve, toward the outside, includes a seat enabling the fetching of the ball and its definitive blocking. The seat may also be made between the end of the tongue and the top and/or rim of the cup.

In this latter embodiment, the transmission element preferably includes a protrusion located vertically of the seat, enabling depressing the ball into its seat when pressure is exerted on the pushbutton, which displaces the transmission element toward the tongue.

In the case where the container must be used in the top up position, the conduit is inclined such that the end remote from the valve toward the outside is closer to the top of the cup than the end near the valve.

In the case where the container must be used in the top down position, the conduit is inclined such that its end remote from the valve toward the outside is farther from the top of the cup than the end near the valve.

In the case where the container must obligatorily be used in the top up position and then in the top down position, the conduit is inclined such that the end remote from the valve toward the outside is closer to the top of the cap than the end near the valve; the tongue is of elastic material and is mounted in floating fashion at its end; the tongue is provided at its end remote from the valve toward the outside with a seat enabling the fetching of the movable device; and vertically of the seat, the transmission element is provided with a protrusion enabling depression of the ball into its seat when the pushbutton is depressed.

The blocking system functions as follows, when for example it is desired that the pressurized container be used in the top up position. When the user attempts the actuate the pushbutton, while the container is in the undesirable top down position, with the end of the conduit located in the vicinity of the valve in this position being at its lowermost point, the movable device circulates in the conduit by gravity and comes to be placed at the end of the conduit located in the vicinity of the valve. If the user presses on the pushbutton, the thrust acts on a rigid assembly, embodied by the transmission element, the movable device, and the tongue, if the tongue is rigid, or by the transmission element, the movable device, the tongue and the rigid surface on which the tongue rests, if the tongue is elastic. When the user inverts the pressurized container, that is, moves it to the top up position, the lowermost end of the conduit is now the end farthest from the valve toward the outside. The system is not blocked. In fact, in the case where the tongue is of flexible material and is mounted in floating fashion at the end most remote from the valve toward the outside, pressure exerted on the pushbutton at the end of the conduit located in the vicinity of the valve displaces the element for transmitting the thrust to the tongue, possibly crushing the film hinge; at the other end, because of the elasticity of the tongue and because of the fact that the tongue is mounted in floating fashion, the assembly comprising the transmission element, movable device, and tongue is displaced toward the top of the cup. Under these conditions, the pushbutton can be depressed to open the valve. Additionally, in the case where the tongue is rigid and rests on the top and/or rim of the cup, because the space between the transmission element and the tongue at the end of the conduit farthest from the valve toward the outside is greater than the diameter of the movable device, the transmission element can move closer to the tongue when the movable device is located at the end the conduit most remote toward the outside. The pushbutton can be depressed and the valve can be acuated.

In the case where the pressurized container must function in the top down position, the functioning of the blocking system is the same, except that the conduit is inclined in the opposite direction.

In the case where the container must obligatorily be used first in the top up position and then later in the top down position, for example, the functioning is as follows. If the user attempts to actuate the container in the top down position before having actuated it in the top up position, the blocking system functions as described above for a container that must function in the top up position. When the user puts the container in the top up position, the movable device circulates by gravity toward the end of the conduit remote from the valve toward the outside. When the user presses on the pushbutton, the transmission element tends to move closer to the tongue, rests with its protrusion on the movable device and depresses it with force into the seat made in the tongue, or between the tongue and top and/or rim of the cup. The movable device is kept in its seat by elasticity and remains blocked there regardless of the position of the container. When the user consequently puts the container in the top down position, the movable device can then no longer assume a place at the end of the conduit located in the vicinity of the valve. The pushbutton can be depressed, and consequently the valve can be actuated.

BRIEF DESCRIPTION OF THE DRAWINGS

The subject of the present invention will be better understood from the ensuing detailed description of three purely exemplary and non-limiting embodiments of a pressurized container according to the invention, taken in conjunction with the drawings.

FIG. 1 is a partially cutaway view of a pressurized double-compartment container, showing an actuating device in a side view.

FIG. 2 is a view in diametral section of the end near the valve of a pressurized container according to the invention for use top down.

FIG. 2*a* is a perspective view from above of the blocking sytsem of FIG. 2.

DETAILED DESCRIPTION OF THE INVENTION

Figure 6:
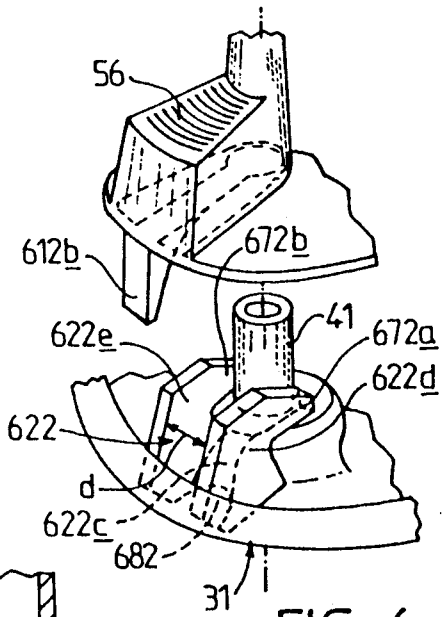
FIG. 6 is a perspective view of the blocking system of FIG. 5 in this second exemplary embodiment of the invention.

The pressurized container, designated in its entirely by reference numeral 1 (see FIG. 1), includes a cylindrical can 2, provided with a bottom 21 and to one end of which a circular cup 3 is affixed that is provided with a valve 4, and to the rim of which a device 5 for actuating the valve 4 is fitted. The cup 3 is fixed to the edge of the cylindrical can 2 by a bead 31. The valve 4 is mounted in the center of the cup 3 in a reinforcement 32 of roughly cylindrical shape, including a substantially plane surface 33 toward the outlet of the valve 4. The valve 4 includes a dispensing tube 41. The device 5 for actuating the valve 4 includes a skirt 51 of cylindrical form that fits by elasticity over the bead 31 of the cup. The skirt includes one portion 52 of more constrained cross section, which is located beyond the bead 31 and prevents excessive depression of the device for actuating the valve 4 and makes possible the provision of a roughly cylindrical space above the cup 3 and below the part of the valve actuating device 5 that forms the cap. The device 5 includes a nozzle 53 comprising two conduits 53*a*, 53*b* parallel to the axis of the can 2 and offset with respect to one another and communicating with one another via an opening 53*c*. The conduit 53*b* is located in the extension of the outlet tube 41 of the valve 4. The device 5 for actuating the valve also includes a pushbutton, which has the shape of a sector of a circle centered on the conduit 53*a* of the nozzle 53. A slit in the form of a circular arc is made in the base of a pushbutton, in such a way as to permit depressing the pushbutton when pressure is exerted on its surface 56. The pushbutton 54 contains the conduit 53*b* of the nozzle 53, and this conduit is closed by the surface 56 of the pushbutton. The wall of the conduit 53*b* includes a notch 55 into which the end of the outlet tube 41 of the valve 4 is inserted. In this way, if pressure is exerted on the surface 56 of the pushbutton and the pushbutton is depressed, the wall of the conduit 53*c* is depressed and presses on the end of the outlet tube 41 of the valve 4, which causes the valve 4 to open.

FIG. 2 shows a particular embodiment of the top of a container that must be used in the top down position. This system is placed between the top of the cup 3 and the device 5 for actuating the valve. The blocking system comprises a transmission element 61, a tongue 62 and a ball 63. The transmission element 61 and the tongue 62 form a conduit 64 between them. In the embodiment shown in FIG. 2, the transmission element 61 and the tongue 62 are hollow in the form of a gutter for the passage of the ball 63; the gutters of the transmission element 61 and of the tongue 62 face one another. Between the transmission element 61 and the tongue 62, there is also a space 65, the height of which is less than the diameter of the ball. The conduit 64 thus comprises the two hollow gutters in the transmission element 61 and tongue 62 and the portion of the space 65 made between the transmission element and the tongue vertically of the two gutters. The cross section of the conduit 64 is slightly smaller at its end 64*a* than at its end 64*b*. The conduit 64 thus widens from the vicinity of the valve 4 toward the outside. The transmission element 61 has a shape complementary to that of the pushbutton 54, to enable it to nest within the pushbutton. It includes a portion 61*a* that is located under the free edge of the conduit 53*b* containing the outlet tube 41 of the valve and above the conduit 64. The tongue 62 rests at its end 62*a* near the valve 4 on the surface 33 of the reinforcement 32 of the cup 3. Its other end 62*b* is mounted in floating fashion. The transmission element 61 and the tongue 62 are connected by a film hinge 66. The end 62*a* of the tongue is hooked onto the outlet tube 41 of the valve by a yoke 67. In the embodiment shown, the transmission element 61, the tongue 62, the film hinge 66 and the yoke 67 form a single part, which is obtained by molding of a flexible plastic material. In the embodiment shown in FIG. 2, the conduit 64 is inclined such that its end 64*a* closest to the outlet tube 41 of the valve 4 is closer to the top of the cup 3 than its other end 64*b*.

The container shown in FIG. 2 functions as described hereinafter. When the pressurized container is in the top up position, the ball comes to lodge by gravity at the end 64*a* of the conduit 64, which at that time is lowermost. If pressure is exerted on the surface 56 of the pushbutton 54, the lower edge of the wall of the conduit 53*b* comes to press against the portion 61*a* of the transmission element 61. At this level, the ball 63 fills the conduit 64, and the tongue 62 rests on a fixed surface. Consequently, the pushbutton cannot be depressed. It is blocked and can no longer actuate the valve 4.

If the pressurized container 1 is inverted to put it in the top down position, then it is the end 64*b* of the conduit that is the lowermost, and the ball comes to be placed by gravity at that end. In the case where the user presses on the pushbutton 54, the pushbutton can be depressed. In fact, by pressing on the pushbutton, the transmission element 61 is displaced toward the tongue 62. At the end 64*a* of the conduit, because of the space 64, the transmission element 61 can be depressed toward the tongue, causing the flexion of the hinge 66. At the other end 64*b*, because the transmission element 61 and the tongue 62 are made solid by the ball 63, it is the combination of the transmission element 61 and the tongue 62 that is depressed, because of the fact that the tongue 62 is of flexible material and is mounted in floating fashion. The depression of the pushbutton 54 causes the depression of the outlet tube 41 of the valve 4 and consequently the opening of this valve.

Figure 3:
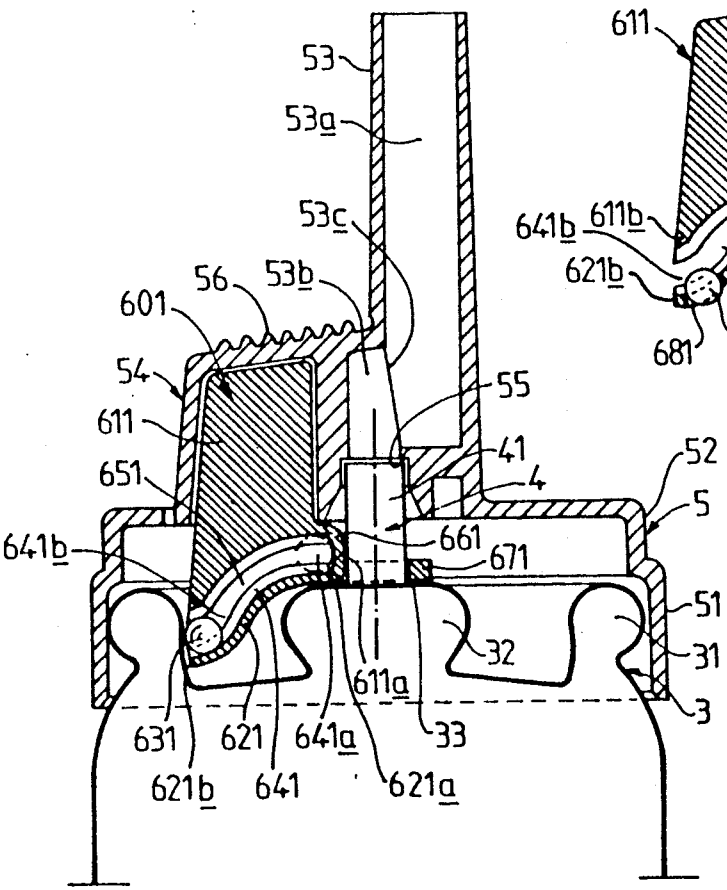
FIG. 3 is likewise a view in diametral section of the end near the valve of a pressurized container according to the invention, for use top up.

FIG. 3 shows an embodiment of the top of a pressurized container for use in the top up position. The blocking system 601 includes a transmission element 611 and a tongue 621 that between them form a conduit 641 for the passage of the ball 631 as well as a space 651. The conduit 641 is inclined in the opposite direction from the conduit 64 shown in FIG. 2; that is, the end 641*a* located in the vicinity of the outlet tube 41 of the valve 4 is located farther from the top of the cup 3 and is at the lowermost position when the pressurized container 1 is in the top down position. The end 641*b* located in the vicinity of the rim of the cup 3 is located closer to the top of the cup and is at its lowest point when the container is in the top up position. The functioning of the blocking system is as follows. When the container is in the top up position, the ball 631 is located at the end 641*b* of the conduit 641. Because of the space 651, the transmission element 611 is depressed, causing the flexion of the hinge 661 at the end 641*a* of the conduit. At the end 641*b*, because the ball solidly joins the transmission element 611 and the tongue 621, it is the combination of the transmission element 611 and tongue 621 that is depressed, because of the fact that the tongue 621 is flexible and is mounted in floating fashion at its end 621*b*.

When the container is in the top down position, the ball 631, shown in dashed lines in FIG. 3, assumes the position 641*a* by gravity. The ball prevents any depression of the transmission element 611 toward the tongue 621. The pushbutton 54 cannot be depressed.

Figure 5:
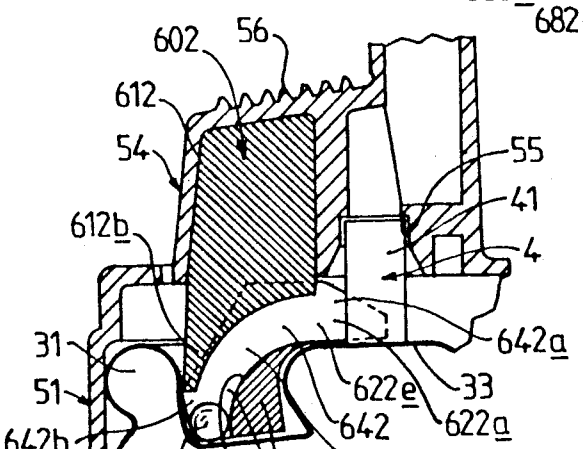
FIG. 5 is also a sectional view of the end near the valve of the pressurized container for use top up and then top down, in accordance with a second exemplary embodiment.
Figure 4:
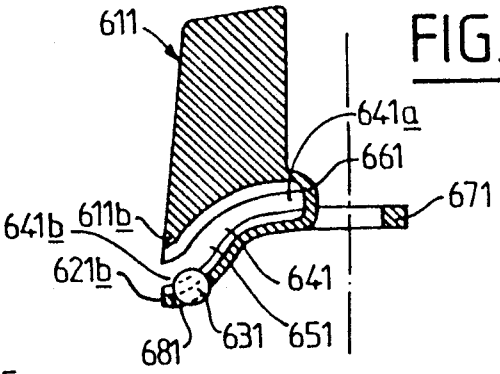
FIG. 4 is a sectional showing in detail the blocking system of the container for use first top up and then top down.

FIG. 4 shows a modification of the blocking systems shown in FIG. 5, for a pressurized container the first use of which must obligatorily be in the top up position, and subsequent uses of which are in the top down position. In this modification, the end 621*b* of the tongue 621 includes a seat 681 in the form of a spherical cap enabling the fetching of the ball 631 and its definitive blocking. Vertically of this seat 681, the 5 transmission element 611 includes a protrusion 611*b* making it possible to depress the ball into the seat 681.

As long as the container has not been used in the top up position, it is impossible to use it in the top down position, because in that case the ball 631, which is not depressed into the seat 681 and can be displaced freely in the conduit 641, arrives at the end 641*a* of the conduit, and the pushbutton 54 is blocked. Upon the first use in the top up position, the ball assumes its position at the end 641*b* of the conduit 641. When the user presses on the pushbutton 54, the protrusion 611 descends along with the transmission element 61 and forcefully depresses the ball 631 into its seat 681, where it remains blocked because of the elasticity of the material of which the tongue 621 is made.

The ball 631 can no longer be displaced at the end 641*a*, when the container is in the top down position, to block the pushbutton 54; because of the space 651 made between the transmission element 611 and the tongue 621, and because of the flexibility of the parts, thrust exerted on the surface 56 of the pushbutton 54 depresses the pushbutton and the transmission element 611, and the portion 611*a* actuates the valve 4.

FIGS. 5 and 6 show a second embodiment of the blocking system of a pressurized container according to the invention, the use of which obligatorily necessitates a first use in the top down position. In this embodiment, the blocking system 602 includes a transmission element 612, a tongue 622 and a ball 632. The tongue 622 includes one inclined surface 622*c* and two parallel lateral walls 622*d* and 622*e*, spaced apart by a distance d equal to the diameter of the outlet tube 41 of the valve 4. These lateral walls 622*d* and 622*e* include two fixation lugs 672*a* and 672*b*, which are fixed by elasticity to the outlet tube 41 of the valve 4.

At its end 622*b*, the inclined surface 622*c* of the tongue is recessed in such a way as to form a seat 682, between this inclined surface 622*c* and the crimping 31 of the 3, for the ball 632. The transmission element 612 is affixed to the inside wall of the pushbutton 54 and includes a protrusion 612*b* vertically of the seat 682 of the tongue 622. The thickness of the transmission element 612 is slightly less than the distance d between the lateral walls 622*d* and 622*e*, to enable its insertion without friction between the two walls 622*d* and 622*e*. The transmission element 612 and the tongue 622 are made of rigid material, preferably rigid plastic material.

The system functions similar to that shown in FIG. 4. When the user attempts to use the pressurized container 1 in the top down position, the ball moves to the end 642*a* of the conduit 642 and blocks the pushbutton 64. When the user uses the pressurized container 1 in the top up position, the ball circulates toward the end 642*b* of the conduit 642, and when the user presses on the pushbutton 54, the protrusion 612*b* depresses the ball 632 into its seat 682, where it remains blocked as shown in FIG. 5. Simultaneously, the pushbutton causes the opening of the valve 4. Consequently, the pressurized container can normally be used in the top down position, because a space remains between the protrusion 612*b* and the ball 632 when the ball has been depressed into its seat.

FIG. 1 also shows, by way of example, a pressurized container with a double compartment, the use of which requires a first use obligatorily in the top up position and then a normal use in the top down position. This system is intended to permit simultaneous preservation in the pressurized container of two products A and B which must not be mixed until the moment of use. The cylindrical can 2 includes a flexible pouch 22 that in turn contains a capsule 23 provided with a stopper 24.

The pressurized container is filled as described below. The first liquid A is introduced into the cylindrical can 2. The second liquid B and a capsule 23 provided with the stopper 24, containing a propellant (such as dichlorodifluoroethane, sold under the tradename Freon 12 by DuPont) in liquified form are introduced, cold, into the flexible pouch 22. Before the liquified propellant can reach ambient temperature, the pouch 22 is closed by heat-sealing, and it is placed inside the cylindrical can 2. The cup 3 containing the valve 4 is crimped, and a counterpressure gas such as nitrogen or any other gas that is not active with respect to the product A is introduced through the valve 4, until the pressure is sufficient to prevent the tube 23 from opening in response to the thrust of the propellant it contains. Next, the assembly comprising the valve actuating device 5 and the blocking system 601 or 602 are placed on the cylindrical can.

The use of the pressurized container is as follows. With the pressurized container 1 in the top up position, pressure is exerted on the pushbutton 54 to cause the nitrogen to escape. The pressure on the interior of the container 1 decreases, so that the stopper 24 is disengaged from the tube 23 and the Freon inflates the pouch 22 until the pouch bursts. The product B is now in contact with the product A, and the two products can be mixed manually shaking the container 1.

Next, to distribute the mixture, the valve 4 is acuated when the container 1 is in the top down position.

In the absence of the blocking system 601, 602, if the user were to begin to actuate the valve while the container 1 is in the top down position, he would run the risk of distributing only the liquid A, or at least a portion of the liquid A, before the counterpressure gas had been able to escape and cause the pouch 22 to break. Consequently, there would be the risk that some of the liquid A would be distributed before the liquid A was mixed with the liquid B.

I claim:

1. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said transmission member and said tongue are connected to one another through a flexible member.

2. The pressurized container as claimed in claim 1, wherein said flexible member is a film hinge.

3. The pressurized container as claimed in claim 2, wherein said tongue is connected to said valve by means of a yoke.

4. The pressurized container as claimed in claim 3, wherein said transmission member, tongue, yoke and film hinge are formed as a single piece molded of plastic material.

5. The pressurized container as claimed in claim 4 wherein said tongue at the end thereof remote from said valve includes a seat for receiving and holding said locking member.

6. The pressurized container as claimed in claim 5, wherein said seat is disposed between the end of said tongue and said cup.

7. The pressurized container as claimed in claim 6, wherein said transmission member includes a protrusion extending toward said seat for engaging said locking member and forcing said locking member into said seat when pressure is exerted on said pushbutton.

8. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein one of said transmission member and said tongue are provided with a groove to define said guide conduit.

9. A pressurized container of the type having a top and where the container is intended to be used first in a top up position and then in a top down position, as claimed in claim 8, wherein said guide conduit has a first end remote from said valve and a second end adjacent to said valve with said first end being disposed below said second end when said top faces vertically upwardly, said tongue being of elastic material having a first end remote from said valve that is free to move and having at said first end a seat for receiving said locking member, said transmission member being provided with a protrusion disposed above said seat so that when said pushbutton is depressed, said protrusion will force said locking member into said seat.

10. A pressurized container is claimed in claim 9, wherein said tongue and transmission member are connected by a film hinge adjacent said valve, said film hinge being connected to said valve by a yoke and said yoke, transmission member and tongue being formed integrally in one piece by molding, said transmission member and said tongue having facing grooves defining said guide conduit, said tongue having a first end remote from said valve lying adjacent said cup, said cap having a nozzle including a passage defined by a wall and said transmission member having a portion located under said edge of said wall.

11. The pressurized container as claimed in claim 10, wherein said container includes a first product and a second product enclosed within a flexible pouch disposed within said container said flexible pouch including a capsule having a stopper, said capsule containing a propellent and said container including a gas to prevent said propellant from opening said capsule.

12. The pressurized container as claimed in claim 9, wherein said container includes a first product and a second product enclosed within a flexible pouch disposed within said container said flexible pouch including a capsule having a stopper, said capsule containing a propellent and said container including a gas to prevent said propellant from opening said capsule.

13. A pressurized container as defined by claim 8, characterized in that the locking member is a ball.

14. A pressurized container as defined by claim 8 or 13, characterized in that the pressurized container is cylindrical, the valve being disposed in the center of the cup, which is circular; and that the guide conduit is disposed radially in the vicinity of the valve and extends radially outwardly.

15. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said guide conduit has a smaller cross-section at an end thereof located adjacent said valve relative to its cross-section at an end thereof located radially spaced from said valve.

16. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said tongue is made of an elastic material and has one end mounted adjacent said valve and an opposite free end.

17. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said tongue is of rigid material and has one end disposed remote from said valve, said one end resting on said cup and space being provided between said transmission member and said tongue at said one end which is larger than the diameter of said locking member.

18. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said guide conduit has one end remote from said valve and an opposite end and said remote end, when said cup faces vertically upwardly, is located vertically below the level of said opposite end of said guide conduit which is adjacent to said valve.

19. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and a unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said guide conduit has opposite ends, one of which is remote from said valve and spaced a distance from said cup that is greater than the distance of said opposite end of said guide conduit at a point adjacent to said valve.

20. A pressurized container including a valve and an actuating means for said valve, said container having a cup mounted on one end thereof with said valve carried by said cup, said actuating means including a cap disposed on said cup and surrounding said valve, said cap having a pushbutton movable relative to said cup between an actuated and a deactuated position, control means for controlling movement of said pushbutton and comprising a locking means including a guide conduit and locking member disposed to move along said guide conduit between a locking and an unlocking position under the influence of gravity and of the orientation of said container, said guide conduit being defined partly by a displaceable transmission member disposed to transmit movement of said pushbutton to alter the size of said guide conduit of said locking means and partly by a tongue so that, with said locking member disposed in said locking position on said guide conduit, said transmission member will block movement of said pushbutton from said deactuated position and, with said locking member disposed in said unlocking position on said guide conduit, said transmission member will permit movement of said pushbutton from said deactuated position to said actuated position wherein said valve includes an outlet tube, said transmission member and tongue are of rigid plastic material, said transmission member being fixed to said pushbutton and said tongue including an inclined surface and two laterally parallel walls spaced part by a distance equal to the diameter of the outlet tube of the valve, said lateral walls including two lugs fictionally engaging said outlet tube of the valve, said inclined surface of said tongue being recessed at its end remote from said valve to form a seat for said locking member between said inclined surface and a portion of said cup, said transmission element including a protrusion located vertically above said seat when said cup faces vertically upwardly and having a thickness slightly less than the distance between said lateral walls.

21. The pressurized container as claimed in claim 20, wherein said container includes a first product and a second product enclosed within a flexible pouch disposed within said container said flexible pouch including a capsule having a stopper, said capsule containing a propellent and said container including a gas to prevent said propellant from opening said capsule.

* * * * *